US009410724B2

(12) United States Patent
Sadot et al.

(10) Patent No.: US 9,410,724 B2
(45) Date of Patent: Aug. 9, 2016

(54) ON-DEMAND BEVERAGE COOLER

(71) Applicants: Avner Sadot, Tel Aviv (IL); Shaul Hanuna, Tel Aviv (IL)

(72) Inventors: Avner Sadot, Tel Aviv (IL); Shaul Hanuna, Tel Aviv (IL)

(73) Assignee: Avner Sadot, Tel Aviv (IL)

( * ) Notice: Subject to any disclaimer, the term of this patent is extended or adjusted under 35 U.S.C. 154(b) by 243 days.

(21) Appl. No.: 14/362,915

(22) PCT Filed: Dec. 12, 2012

(86) PCT No.: PCT/IB2012/057234
§ 371 (c)(1),
(2) Date: Jun. 5, 2014

(87) PCT Pub. No.: WO2013/088366
PCT Pub. Date: Jun. 20, 2013

(65) Prior Publication Data

US 2014/0360208 A1 Dec. 11, 2014

Related U.S. Application Data

(60) Provisional application No. 61/569,303, filed on Dec. 12, 2011.

(51) Int. Cl.

| | |
|---|---|
| ***F25B 21/02*** | (2006.01) |
| ***F25B 21/04*** | (2006.01) |
| ***F25D 31/00*** | (2006.01) |
| *F25D 16/00* | (2006.01) |

(52) U.S. Cl.
CPC ..... *F25B 21/04* (2013.01); *F25D 31/002* (2013.01); *F25B 21/02* (2013.01); *F25D 16/00* (2013.01)

(58) Field of Classification Search
CPC ..... F21B 21/02; B67D 3/0009; F25D 31/002; F25D 23/126
USPC ..... 62/3.3, 3.6, 3.62, 3.64, 389, 396, 530
See application file for complete search history.

(56) References Cited

U.S. PATENT DOCUMENTS 5,269,146 A * 12/1993 Kerner ..... F25B 21/02 165/104.33
5,271,239 A * 12/1993 Rockenfeller ..... C09K 5/047 165/80.2
5,314,586 A 5/1994 Chen
(Continued)

FOREIGN PATENT DOCUMENTS

| | | |
|---|---|---|
| JP | 5018648 | 1/1993 |
| JP | 8021679 | 1/1996 |
| WO | 9707369 | 2/1997 |

*Primary Examiner* — Melvin Jones
(74) *Attorney, Agent, or Firm* — Mark M. Friedman

(57) ABSTRACT

A beverage cooler (10, 100, 200) includes a heat pump (12) having a cooling element thermally coupled to a negative-heat-energy accumulator (14). The accumulator (14) includes a heat-energy dispersion arrangement (16) formed from thermally conductive material which is in thermal contact with a quantity of phase-change material (18) having a phase-change temperature above zero Celsius. A conduit (20) for the beverage defines a circuitous path thermally coupled to accumulator (14). The heat pump (12) draws heat energy predominantly from the phase-change material (18) so as to ensure that a temperature of the phase-change material is reduced by at least as much as the temperature of the beverage within conduit (20), even under zero-flow conditions. This ensures that the accumulator (14) can be fully charged during periods of low beverage dispensing demand without risk of freezing the beverage within conduit (20).

11 Claims, 12 Drawing Sheets

(56) References Cited

U.S. PATENT DOCUMENTS

| | | | |
|---|---|---|---|
| 5,918,468 | A | 7/1999 | Cassells et al. |
| 6,105,659 | A | 8/2000 | Pocol et al. |
| 7,332,075 | B2 | 2/2008 | Sumner et al. |
| 2002/0162339 | A1 | 11/2002 | Harrison et al. |
| 2006/0075761 | A1 | 4/2006 | Kitchens et al. |

* cited by examiner

ON-DEMAND BEVERAGE COOLER

FIELD AND BACKGROUND OF THE INVENTION

The present invention relates to dispensers for dispensing chilled beverages and, in particular, it concerns an on-demand beverage cooler which employs a negative-heat-energy accumulator containing phase-change material (PCM).

U.S. Pat. No. 5,918,468 to Cassels et al. and US Patent Application Publication No. 2002/0162339 A1 to Harrison et al. both teach beverage coolers which incorporate a quantity of phase-change material (PCM). In both cases, however, a heat pump device is thermally coupled primarily to a conduit through which the liquid flows, with the phase-change material merely providing additional thermal inertia for a more uniform cooling effect. Where a PCM with a transition temperature not much above zero Celsius is used, operation of the heat pump under zero flow conditions would be likely to lead rapidly to freezing of any water-based beverage within the conduit.

SUMMARY OF THE INVENTION

The present invention is a beverage cooler.

According to the teachings of an embodiment of the present invention there is provided, a beverage cooler comprising: (a) a heat pump having a cooling element; (b) a negative-heat-energy accumulator thermally coupled to the cooling element, the negative-heat-energy accumulator comprising: (i) a heat-energy dispersion arrangement formed from thermally conductive material, and (ii) a quantity of phase-change material having a phase-change temperature above zero Celsius, the phase-change material being deployed in thermal contact with the thermally conductive material; and (c) a conduit defining a circuitous path for carrying the beverage along at least part of a flow path from an inlet to an outlet, the conduit being thermally coupled to the negative-heat-energy accumulator, wherein the negative-heat-energy accumulator and the conduit are deployed such that an absolute thermal resistance between the cooling element and the quantity of phase-change material is lower than an absolute thermal resistance between the cooling element and water within the conduit, thereby rendering the heat pump effective to cool the phase-change material more rapidly than the beverage within the conduit.

According to a further feature of an embodiment of the present invention, the heat pump comprises at least one thermoelectric cooler (TEC), and wherein the cooling element is a cold plate of the at least one TEC.

According to a further feature of an embodiment of the present invention, the heat pump comprises a vapor-compression refrigeration system.

According to a further feature of an embodiment of the present invention, a majority of a length of the conduit from the inlet to the outlet is immersed in the negative-heat-energy accumulator.

According to a further feature of an embodiment of the present invention, the circuitous path of the conduit includes a plurality of substantially parallel conduit segments passing through openings in the heat-energy dispersion arrangement.

According to a further feature of an embodiment of the present invention, the conduit has an internal diameter, and wherein the circuitous path has a flow-path length greater than 100 times the internal diameter.

According to a further feature of an embodiment of the present invention, the heat-energy dispersion arrangement comprises an arrangement selected from the group consisting of: an array of heat-transfer fins of sub-millimeter thickness; and an open-cell metallic foam.

According to a further feature of an embodiment of the present invention, the heat-energy dispersion arrangement comprises an array of heat-transfer fins of sub-millimeter thickness, the array of fins being spaced apart by gaps of no more than 5 millimeters, the gaps being filled with the phase-change material.

According to a further feature of an embodiment of the present invention, the circuitous path of the conduit includes a plurality of substantially parallel conduit segments passing through openings in the heat-transfer fins.

According to a further feature of an embodiment of the present invention, a majority of a length of the conduit from the inlet to the outlet is integrated within a thermally-conductive block, the thermally-conductive block being thermally coupled to the negative-heat-energy accumulator.

According to a further feature of an embodiment of the present invention, there is also provided a water filter unit, wherein at least part of the water filter unit is received within a recess, the recess being substantially surrounded by the negative-heat-energy accumulator, and wherein the conduit is configured to interconnect with the water filter unit such that the beverage passes through the filter as part of the flow path from the inlet to the outlet.

There is also provided according to the teachings of the present invention a method for cooling a beverage on demand by cooling a negative-heat-energy accumulator by operation of the heat pump under zero flow conditions, and subsequently passing the beverage through a conduit so as to be cooled by heat transfer to the accumulator. Also envisaged is a method corresponding to the mode of operation of any feature of the beverage cooler described herein, alone or in combination with the above method.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
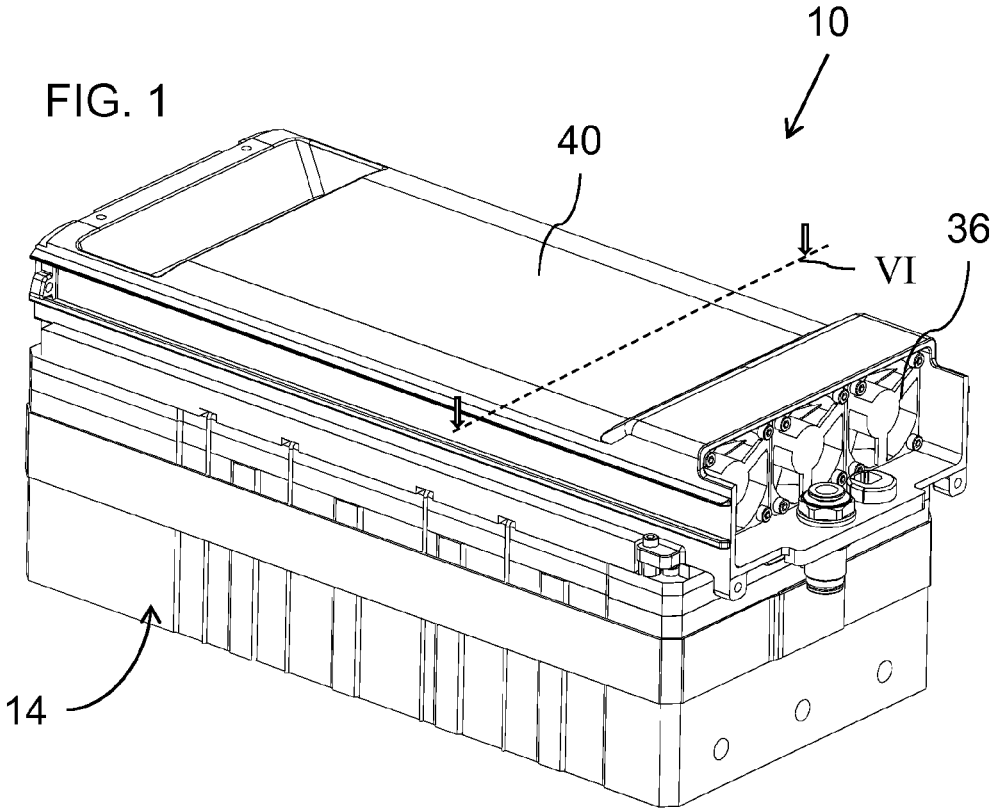
FIG. 1 is an isometric view of a beverage cooler, constructed and operative according to the teachings of an embodiment of the present invention.
Figure 2:
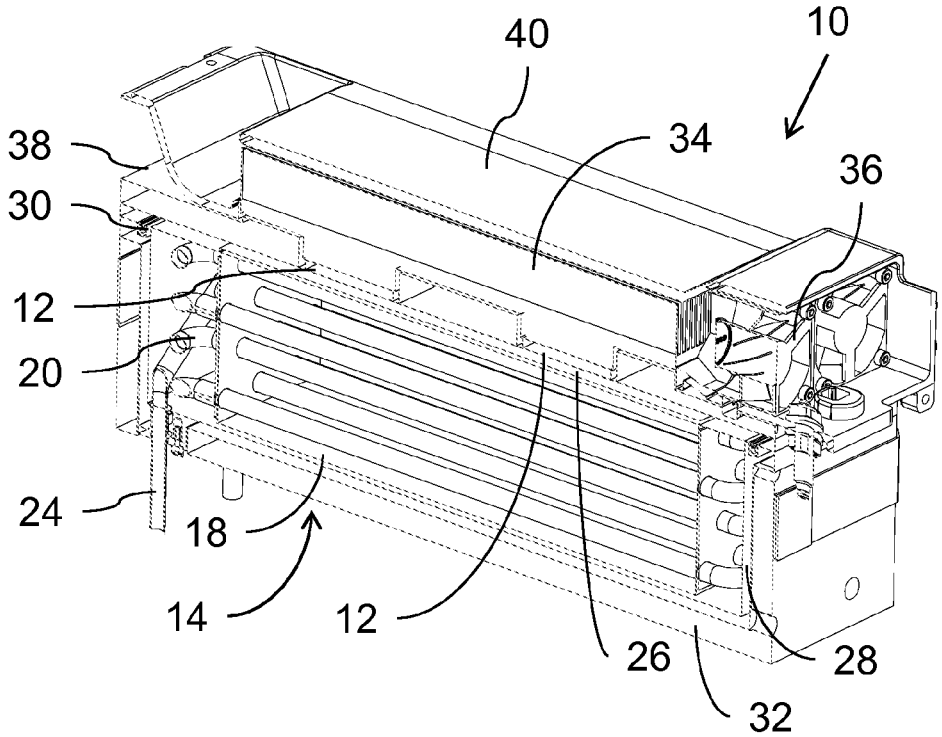
FIG. 2 is a cut-away isometric view of the beverage cooler of FIG. 1.
Figure 3:
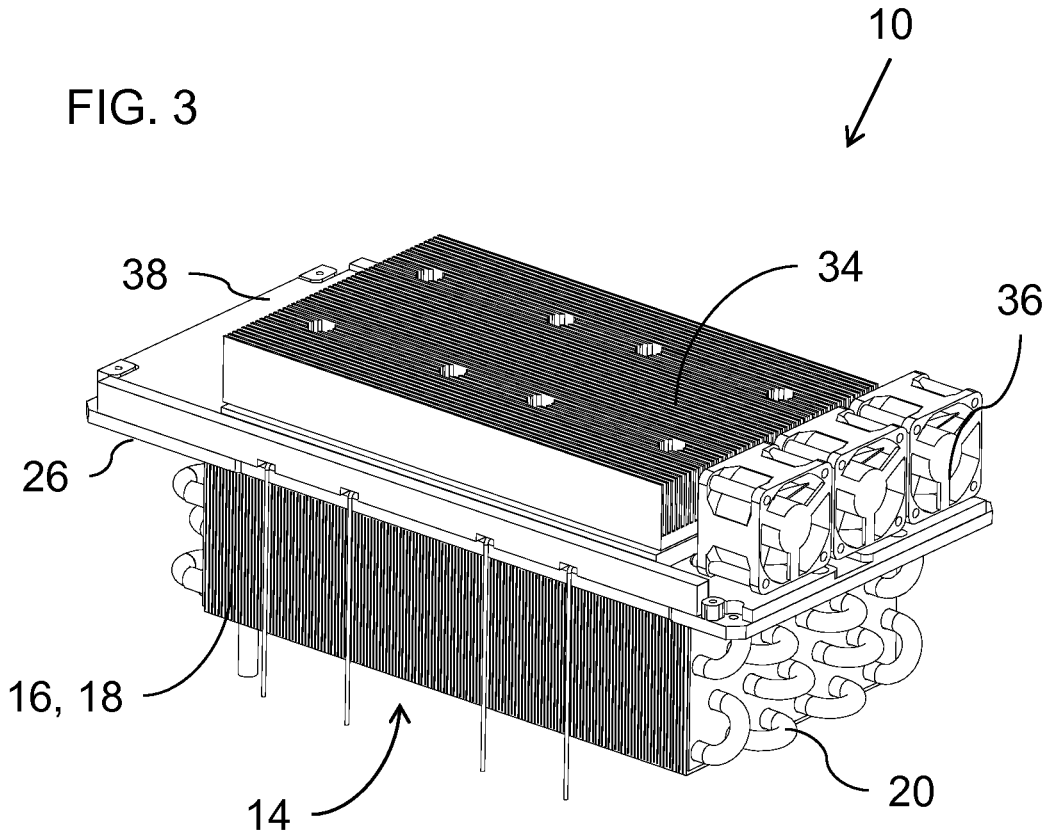
FIG. 3 is an isometric view of the beverage cooler of FIG. 1 with outer covers and a negative-heat-energy accumulator casing removed.
Figure 4:
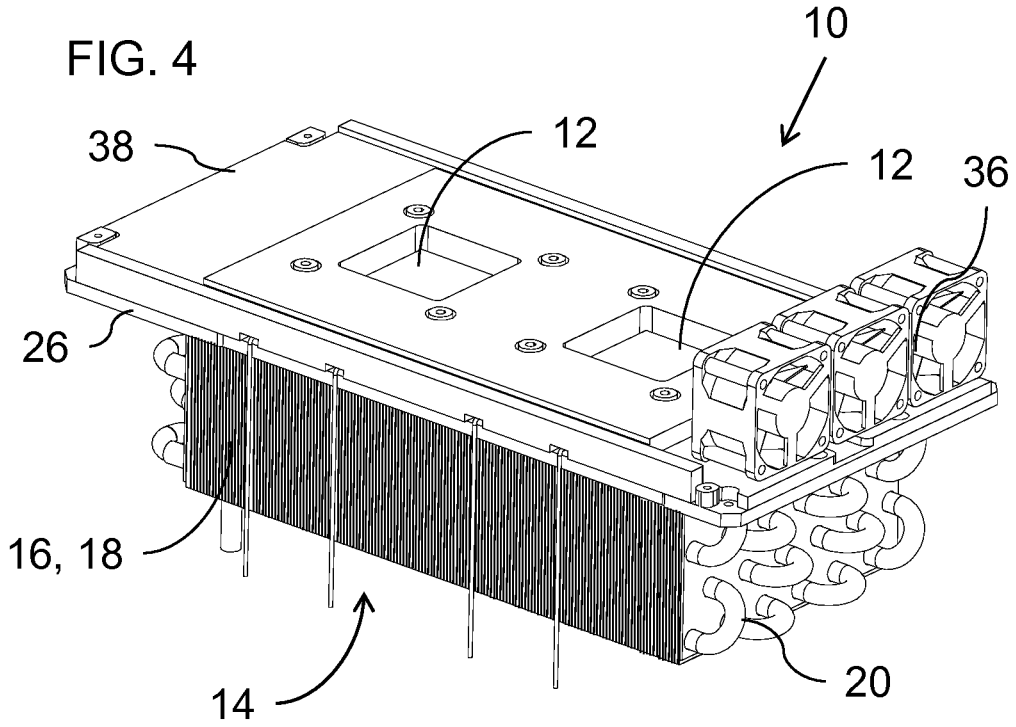
FIG. 4 is an isometric view similar to FIG. 3 with a heat sink removed.
Figure 5:
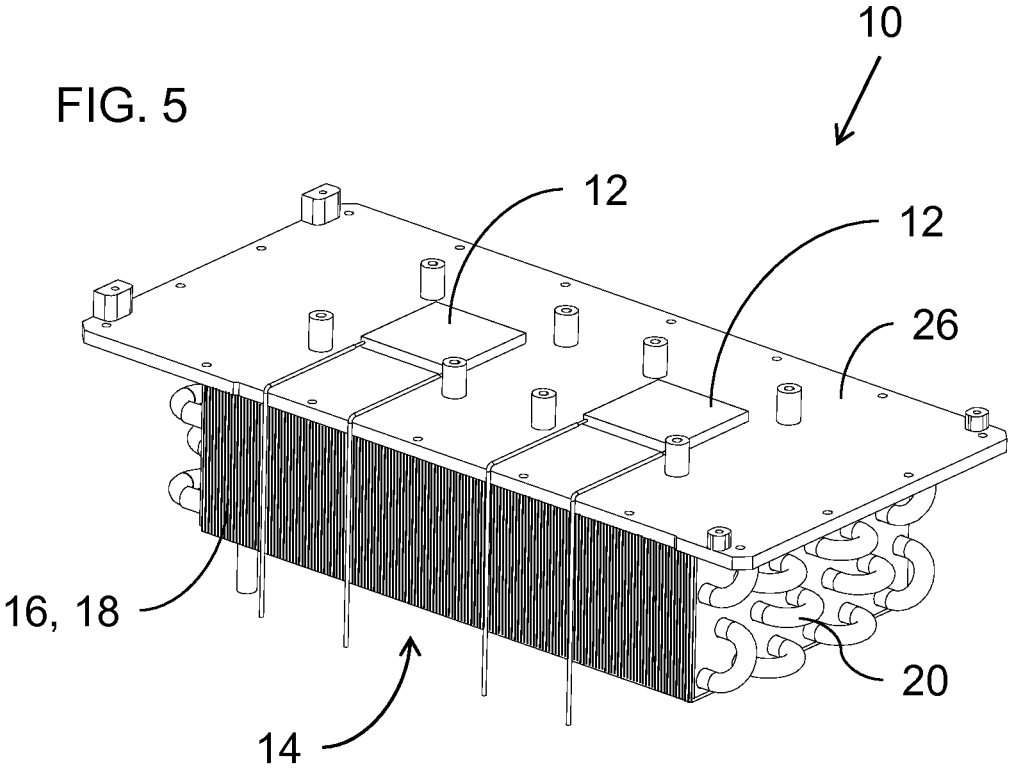
FIG. 5 is an isometric view similar to FIG. 4 with an insulating layer removed.
Figure 6:
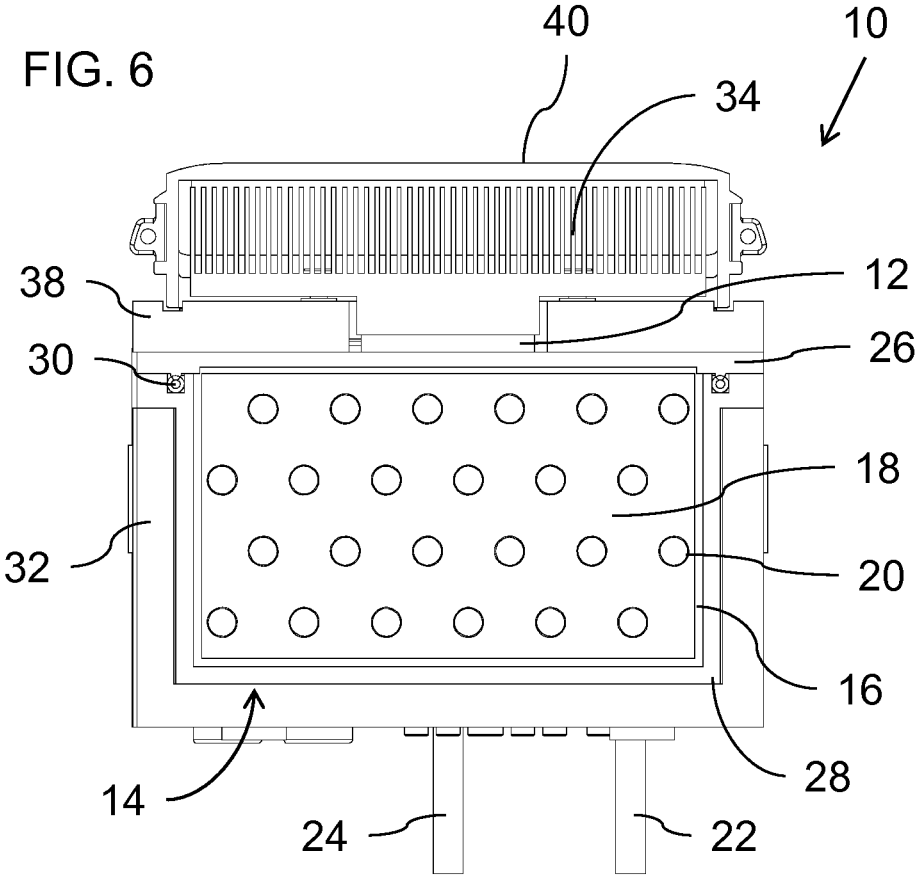
FIG. 6 is a cross-sectional view taken along the plane designated VI in FIG. 1.
Figure 7:
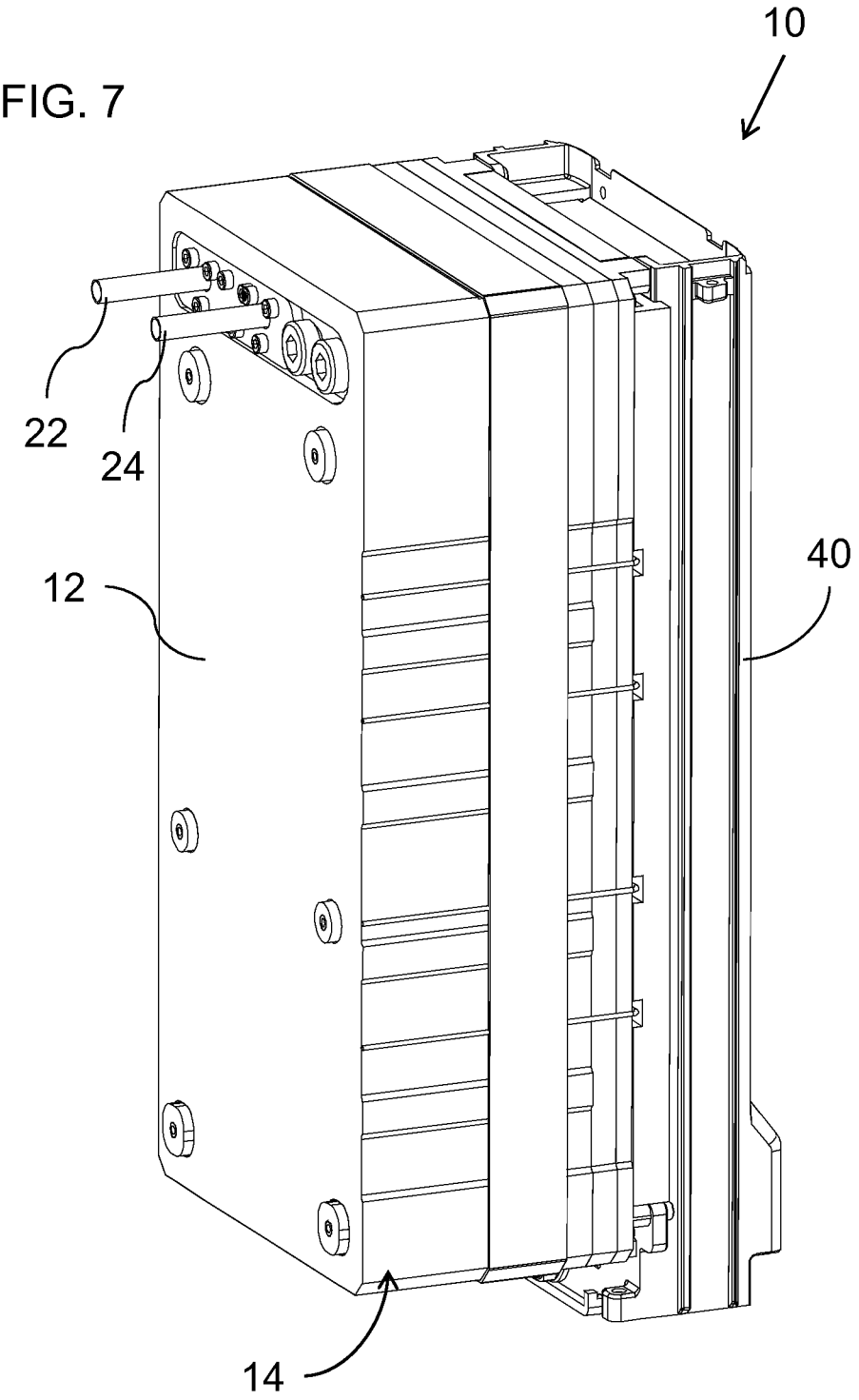
FIG. 7 is a rotated isometric view of the beverage cooler of FIG. 1.
Figure 8:
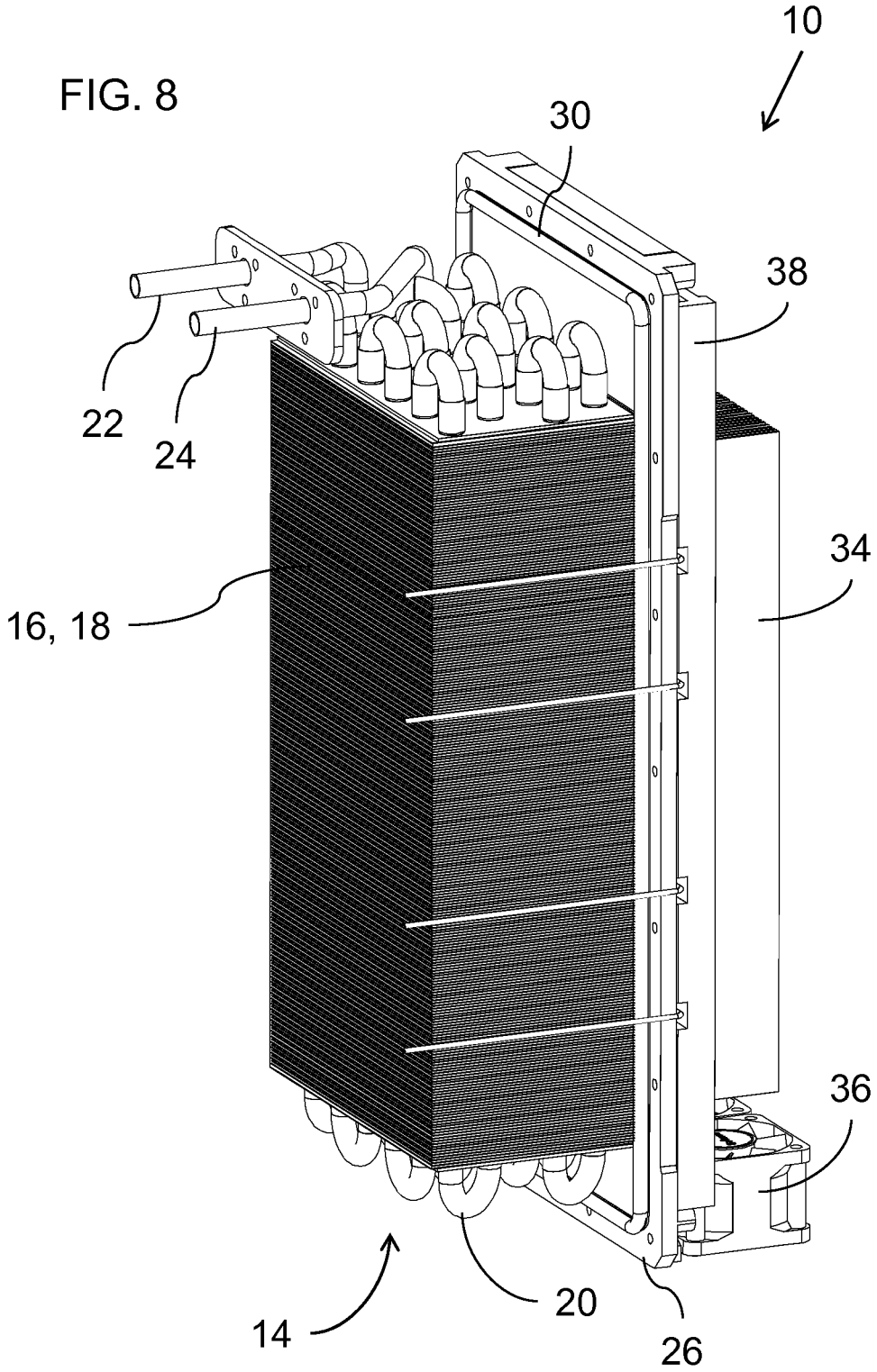
FIG. 8 is an isometric view similar to FIG. 7 with outer covers and a negative-heat-energy accumulator casing removed.
Figure 9:
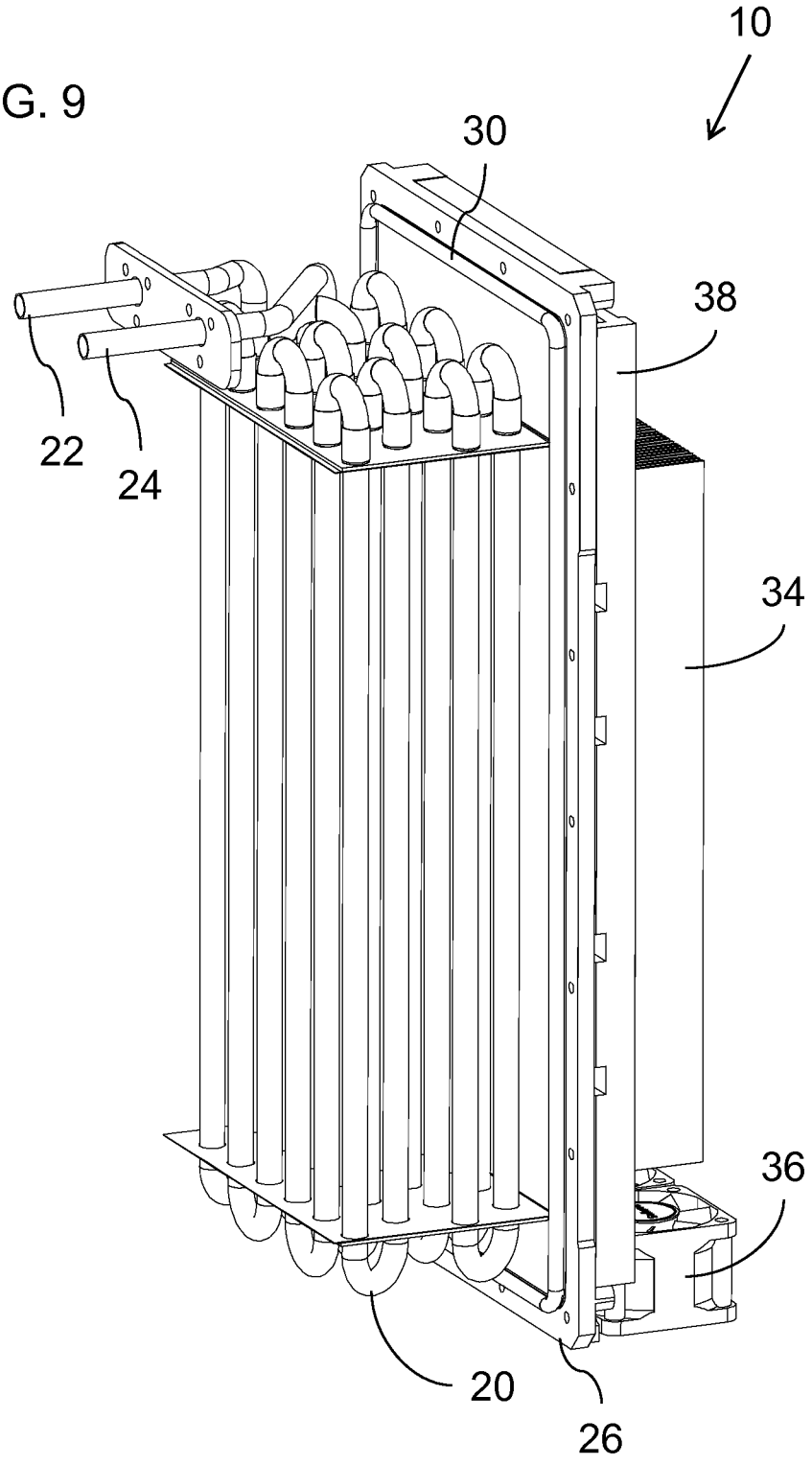
FIG. 9 is an isometric view similar to FIG. 8 with a heat-energy dispersion arrangement removed.
Figure 10:
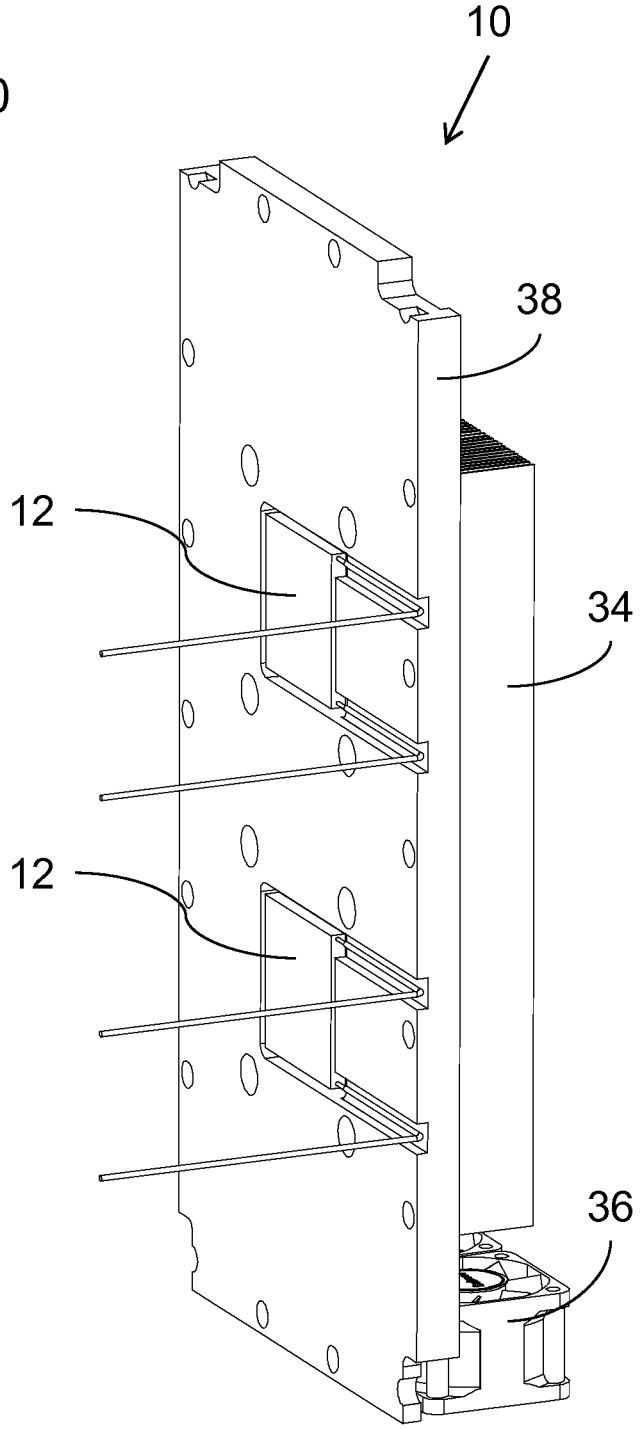
FIG. 10 is an isometric view similar to FIG. 9 with a beverage-conveying conduit removed.
Figure 11:
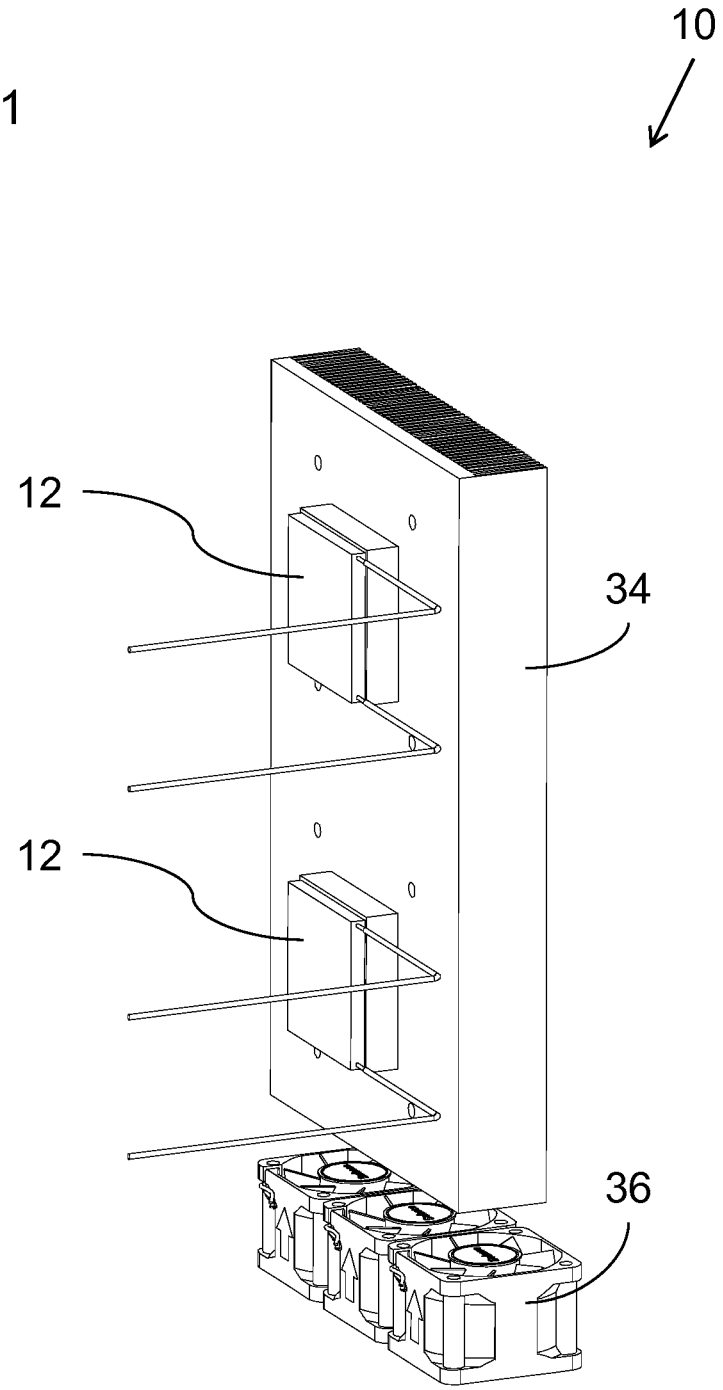
FIG. 11 is an isometric view similar to FIG. 10 with an insulating structure removed.

The present invention is a beverage cooler.

The principles and operation of beverage coolers according to the present invention may be better understood with reference to the drawings and the accompanying description.

Referring now to the drawings, the present invention will be illustrated herein with reference to three non-limiting but particularly preferred embodiments: a first embodiment described with reference to FIGS. 1-11; a second embodiment described with reference to FIG. 12; and a third embodiment described with reference to FIGS. 13-15. For conciseness of presentation, only the first embodiment will be described comprehensively, while the distinguishing features of the subsequent embodiments are subsequently discussed. Accordingly, the following description of FIGS. 1-11 should be considered generic to all embodiments except where explicitly stated otherwise.

FIGS. 1-11 illustrate various features of a beverage cooler, generally designated 10, constructed and operative according to an embodiment of the present invention. In general terms, beverage cooler 10 includes a heat pump 12 having a cooling element thermally coupled to a negative-heat-energy accumulator 14. Negative-heat-energy accumulator 14 includes a heat-energy dispersion arrangement 16 formed from thermally conductive material which is in thermal contact with a quantity of phase-change material 18 having a phase-change temperature above zero Celsius. A conduit 20 carries the beverage along at least part of a flow path from an inlet 22 to an outlet 24. Conduit 20 defines a circuitous path thermally coupled to negative-heat-energy accumulator 14.

It is a particularly preferred feature of certain embodiments of the present invention that negative-heat-energy accumulator 14 and conduit 20 are deployed such that heat pump 12 is effective to cool the phase-change material 18 more rapidly than the beverage within conduit 20. In other words, heat-energy dispersion arrangement 16 is configured such that heat pump 12 draws heat energy predominantly from phase-change material 18 so as to ensure that a temperature of the phase-change material is reduced by at least as much as the temperature of the beverage within conduit 20, even under zero-flow conditions. This ensures that the negative-heat-energy accumulator can be fully charged during periods of low beverage dispensing demand without risk of freezing the beverage within conduit 20.

In order to ensure that thermal coupling between the cooling element and the quantity of phase-change material 18 is more effective than thermal coupling between the cooling element and the beverage within conduit 20, the configuration of negative-heat-energy accumulator 14 is preferably such that an absolute thermal resistance between the cooling element and the quantity of phase-change material 18 is lower than an absolute thermal resistance between the cooling element and water within conduit 20. Structural examples of how this condition is satisfied will be discussed below.

At this stage, it will already be appreciated that the present invention facilitates compact implementation of an on-demand beverage cooler. Specifically, by accumulating "negative-heat-energy" during periods of inactivity, a relatively large quantity of beverage can be cooled on demand as it flows through conduit 20 without requiring a large storage volume for pre-cooled beverage, and while avoiding complications due to freezing of the beverage itself. This and other advantages of the present invention will be better understood from the following description along with the accompanying drawings.

At this stage, it will be useful to define certain terminology as used in the description and claims. The term "beverage" is used to refer to any potable liquid which is to be cooled, and includes water, juices, milk, tea, coffee, wine and other drinks. Beverages are referred to as "water-based" wherever water constitutes a majority of the volume of the beverage, whether such water content is added or naturally occurring. In most particularly preferred implementations, the cooler of the present invention is used as a water cooler, which may be part of a hot/cold or cold-only water dispensing bar, or may be a component in an automated beverage dispensing system in which the cooled water is subsequently mixed with other components to prepare a final beverage.

The term "conduit" is used to refer to any closed structure for accommodating a flow of beverage. Typically the "conduit" of the present invention is a metal tube. In certain implementations, the conduit may be provided at least in part by an arrangement of bores through a solid block of material.

The term "thermally conductive" and other similar terms are used in their intuitive sense to refer to materials and objects which are effective conductors of heat, and refers here primarily, although not exclusively, to metals and metal alloys, referred to generically as "metallic materials". Particularly preferred materials include, but are not limited to, aluminum, copper and stainless steel.

The term "absolute thermal resistance" is defined for a particular structure as the required temperature difference across the structure for a unit of heat energy to flow through the structure per unit time, i.e., degrees Celsius per watt. Thus, the property that the absolute thermal resistance between the cooling element of the heat pump and the phase-change material is lower than the absolute thermal resistance between the cooling element and the beverage within the conduit inherently sets up a hierarchy or priority of the cooling effect as acting primarily on the phase-change material, thereby facilitating full "charging" of the accumulator to below its phase-change temperature without freezing the beverage within the conduit.

Reference is made herein to an accumulator for "negative heat energy". The term "negative heat energy" is used herein to refer to a heat energy deficit relative to ambient conditions and/or the inlet temperature of the beverage, and signifies an ability to absorb heat energy from adjacent materials. This terminology reflects the concept that accumulator 14 functions essentially as a accumulator for storing "cold" which can then be drawn upon to cool the flow of beverage. The accumulator is considered fully "charged" when the phase-change material is fully converted to its solid phase (excluding any dead volume of PCM which may not be in full thermal contact with heat-energy dispersion arrangement 16).

Turning now to the features of beverage cooler 10 in more detail, for certain applications, it is considered advantageous to implement heat pump 12 as one or more thermoelectric cooler (TEC), where the cooling element is the cold plate of the TEC. Such an implementation is illustrated here, with the TEC visible in FIGS. 2, 4-6, 10 and 11. The use of a TEC provides a particularly compact and low-maintenance implementation. The accumulator-based approach of the present invention allows the use of low-power TECs to gradually charge accumulator 14 which then rapidly cools water on-demand.

In an alternative set of implementations (not shown), the heat pump is implemented as a vapor-compression refrigeration system. In this case, the cooling element (evaporator) is preferably implemented as an arrangement of tubes passing through accumulator 14 in a manner similar to, and interspaced with, conduit 20.

Turning now to the structure of negative-heat-energy accumulator 14, a first preferred implementation of heat-energy dispersion arrangement 16 employs an array of heat-transfer fins of sub-millimeter thickness spaced apart by gaps of no more than 5 millimeters. For clarity of presentation, the fins are omitted from FIGS. 2 and 9, but are shown in FIGS. 3-5 and 8. Most preferably, fin thicknesses of between 0.1 millimeter and 0.3 millimeter are used, and gaps between fins are no more than 3 millimeters. Structures with similar parameters, and the corresponding manufacturing techniques, are well known in the field of air-cooled heat exchangers, and will not be described here in detail. According to the teachings of the present invention, this structure is immersed in the phase-change material such that these gaps are filled with the phase-change material. This results in a very high surface area of thermal contact between the fins and the PCM, providing highly effective thermal coupling (low absolute thermal resistance) between the cooling element of the heat pump and the PCM. Thermal coupling to the surface of the TECs 12 is achieved via a thermally conductive plate 26.

The PCM is preferably contained in and around the fins by a housing 28 (FIGS. 2 and 6) which seals against plate 26 at a gasket 30. Housing 28 is preferably surrounded by an outer insulative cover 32. The array of fins preferably substantially spans the internal volume of housing 28, although the periphery of the volume may inevitably have some degree of "dead space" within which the PCM is less effectively thermally coupled. Such dead space is ignored for the purpose of discussion of the thermodynamic performance of the present invention.

A wide range of phase-change materials with suitable transition temperatures are commercially available. The desired transition temperatures for implementing the present invention are clearly above zero Celsius and below the desired dispensing temperature for the beverage, which is typically in the range of 5-12 degrees Celsius. Preferred transition temperatures are typically in the range from 2-8 degree Celsius. By way of one particularly preferred but non-limiting example, a suitable PCM is commercially available from Rubitherm-Technologies GmbH (DE) under the name RUBITHERM® RT 5 HC, with a melting point in the 5-6° C. range.

The status (degree of charge) of the accumulator is preferably monitored by one or more temperature sensor deployed in thermal contact with the PCM. In particular, at least one temperature sensor is preferably deployed in a location which is determined to be the "last to solidify" according to the normal thermal flux patterns of cooling the PCM by operation of the heat pump, thereby providing an indication of the fully-charged state of the accumulator. Most preferably, a plurality of sensors disposed in multiple locations within or adjacent to the accumulator provides data for a more accurate assessment of the state of the accumulator under a wide range of operating conditions.

Turning now to the properties of conduit 20, this is preferably thermally coupled to the arrangement of heat transfer fins by passing through openings in the fins. Effective thermal coupling is best achieved by forming an opening through the fins of size slightly less than the external diameter of the conduit and then forcing the conduit through the openings. To this end, the circuitous path of the conduit preferably includes a plurality of substantially parallel conduit segments passing through openings in the heat-transfer fins. These segments are interconnected by arcuate connecting portions to form an elongated flow path.

It will be noted that the thermal coupling between the fins and conduit 20 is typically along the edges of holes through the fins, in contrast to the large surface contact of the fins with the PCM, thereby ensuring the differential in thermal resistance described above. In certain implementations, separate sets of fins may be provided for thermal coupling of conduit 20 to the PCM without direct coupling to heat pump 12. However, this is typically not necessary.

In order to achieve sufficient heat exchange under continuous flow conditions with preferred dispensing rates of at least 1.5 liters per minute (more preferably 1.8 liters per minute), it is preferable to employ a relatively small-diameter conduit and long flow path. Thus, the internal diameter of conduit 20 is preferably no more than 12 mm, and most preferably in the range of 5-8 mm. The flow path length is preferably at least 3 meters, and most preferably in the range of 5-8 meters. The ratio of flow path length to internal diameter is preferably in excess of 100. In addition to ensuring sufficient dwell-time of the beverage within the conduit and providing a relatively large surface area for heat transfer between the beverage and the conduit, these parameters also encourage generation of turbulent flow characteristics within the conduit, which further greatly enhances heat transfer between the beverage and the conduit wall.

Although described herein in an implementation with an array of heat-transfer fins, it should be noted that an alternative embodiment (not shown) implements heat-energy dispersion arrangement 16 using a quantity of an open-cell metallic foam. A conductive metallic foam with suitably chosen parameters of cell wall thickness and cell size can provide heat distribution properties closely paralleling the fin array structure described above.

Turning now to the remaining features of beverage cooler 10, as best seen in FIGS. 3, 4, 10 and 11, the hot side of each TEC (or other heat pump) 12 is thermally coupled to a heat sink 34 which, in the example shown here, is air-cooled by forced air flow generated by an array of fans 36. An insulating structure 38 separates between the hot and cold sides of the heat pump. An outer cover 40 protects heat sink 34 and defines the air flow vent through which air is driven by fans 36.

As mentioned earlier, beverage cooler 10 typically is part of a larger system which may delivery hot and cold water on demand and/or which may prepare other hot and/or cold beverages. In addition to the structural components illustrated so far, the cooler typically includes various control components which typically include electronically actuated flow control valves, switching logic for actuating and interrupting operation of the heat pump, one or more temperature sensor or thermostat for determining when the PCM in one or more region of the negative-heat-energy accumulator has solidified, one or more user input or control input from another module of an automated system, and an electronic controller responsive to the various sensors and inputs to actuate the valves and heat pump. The control components may be shared with other modules of a composite beverage dispensing system.

In some cases, for example, where adjustable control of beverage dispensing temperature is required, it may be preferable to work with a PCM having a transition temperature at the lower end of the range of dispensing temperatures required and then to mix controlled quantities of chilled beverage and unchilled beverage to obtain the desired final temperature. Mixing may be performed in the cup by simultaneous or sequential dispensing of the chilled and unchilled components into the cup. Alternatively, a dedicated mixing unit is provided to mix chilled and unchilled beverage in the required proportions immediately before dispensing.

Figure 12:
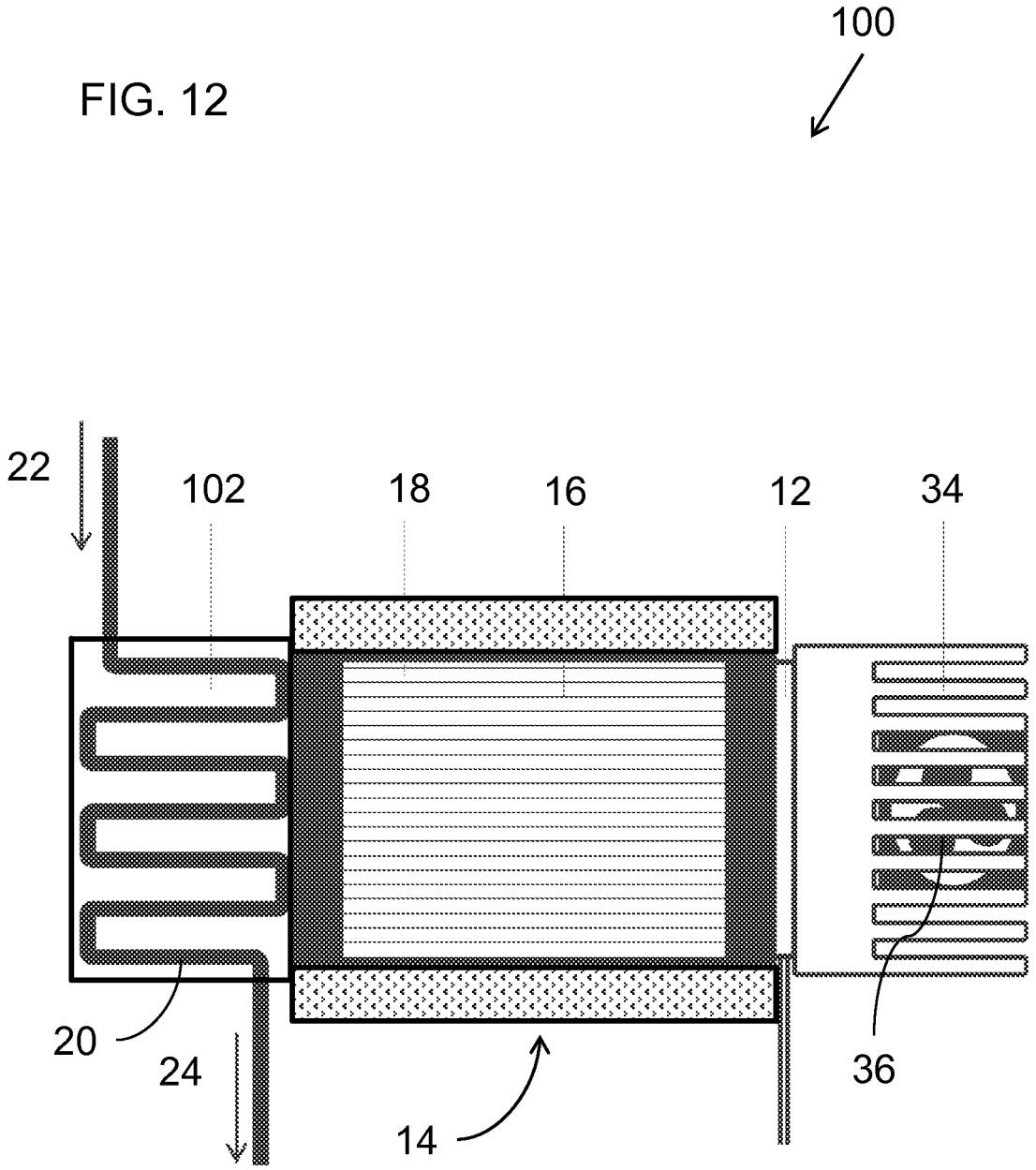
FIG. 12 is a schematic representation of a beverage cooler, constructed and operative according to the teachings of a further embodiment of the present invention.

Turning now to FIG. 12, it should be noted that conduit 20 does not necessarily have to be immersed within negative-heat-energy accumulator 14. In the exemplary beverage cooler 100 illustrated schematically here, a majority of a length of conduit 20 from inlet 22 to outlet 24 is integrated within a thermally-conductive block 102 which is thermally coupled to negative-heat-energy accumulator 14. This configuration clearly also satisfies the aforementioned condition of lower absolute thermal resistance between heat pump 12 and accumulator 14 than between heat pump 12 and conduit 20 since heat transfer from conduit 20 to heat pump 12 occurs via accumulator 14. In all other respects, beverage cooler 100 is similar in structure and function to beverage cooler 10 described above.

Figure 13:
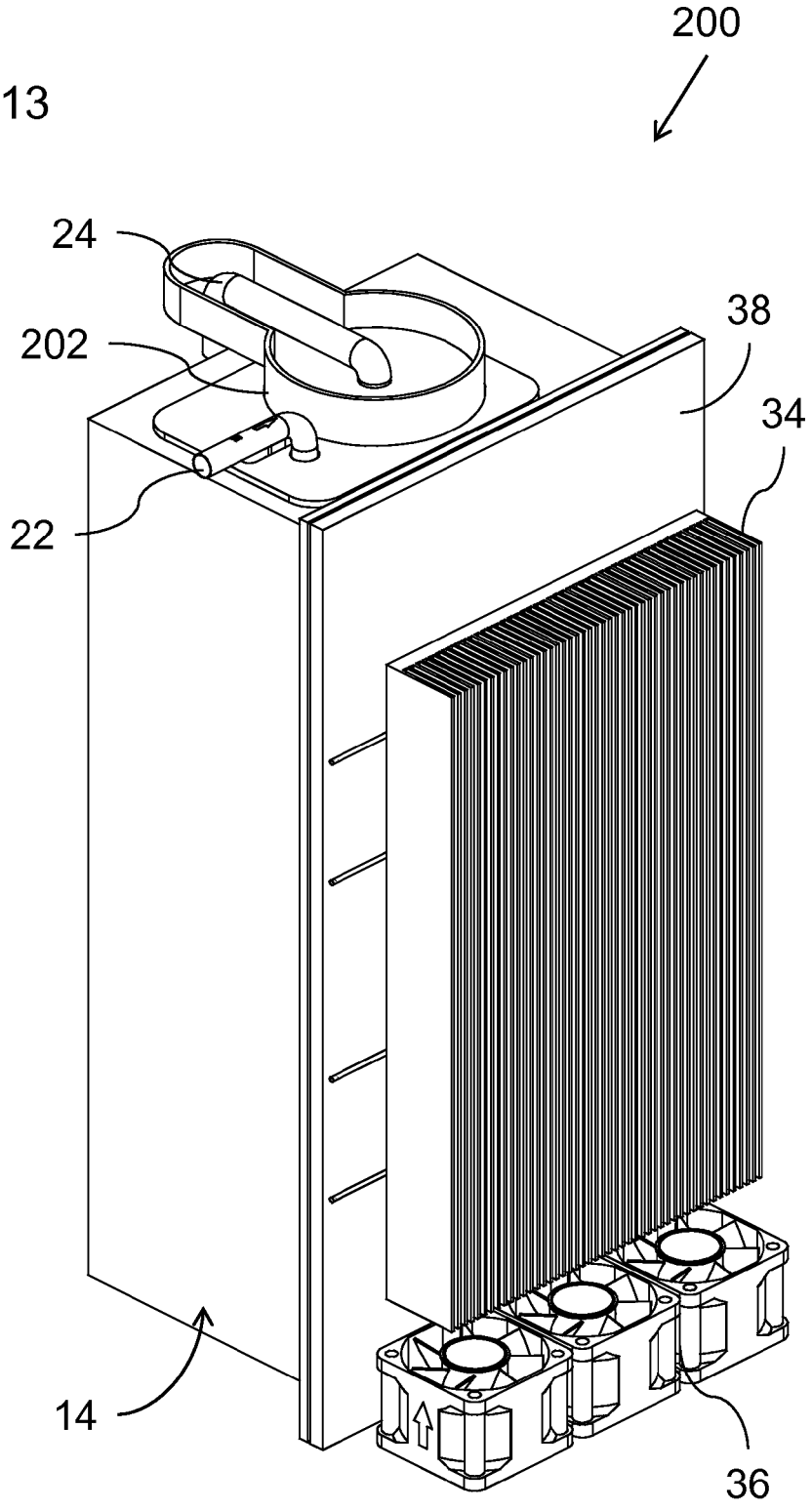
FIG. 13 is a schematic isometric view of a beverage cooler, constructed and operative according to the teachings of a further embodiment of the present invention, employing an integrated water filter unit.
Figure 14:
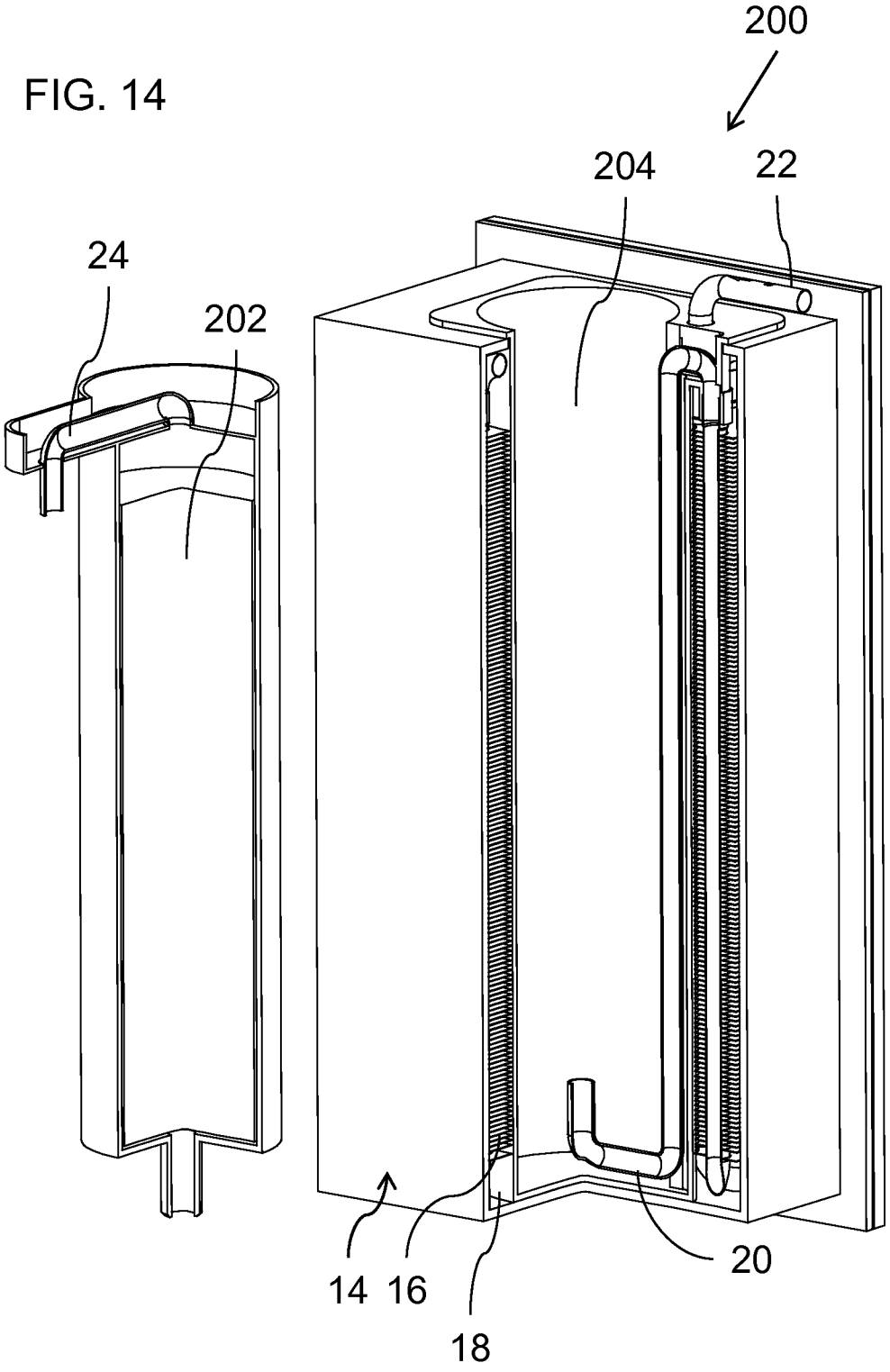
FIG. 14 is an isometric cut-away view of the beverage cooler of FIG. 13 showing the integrated water filter unit removed.
Figure 15:
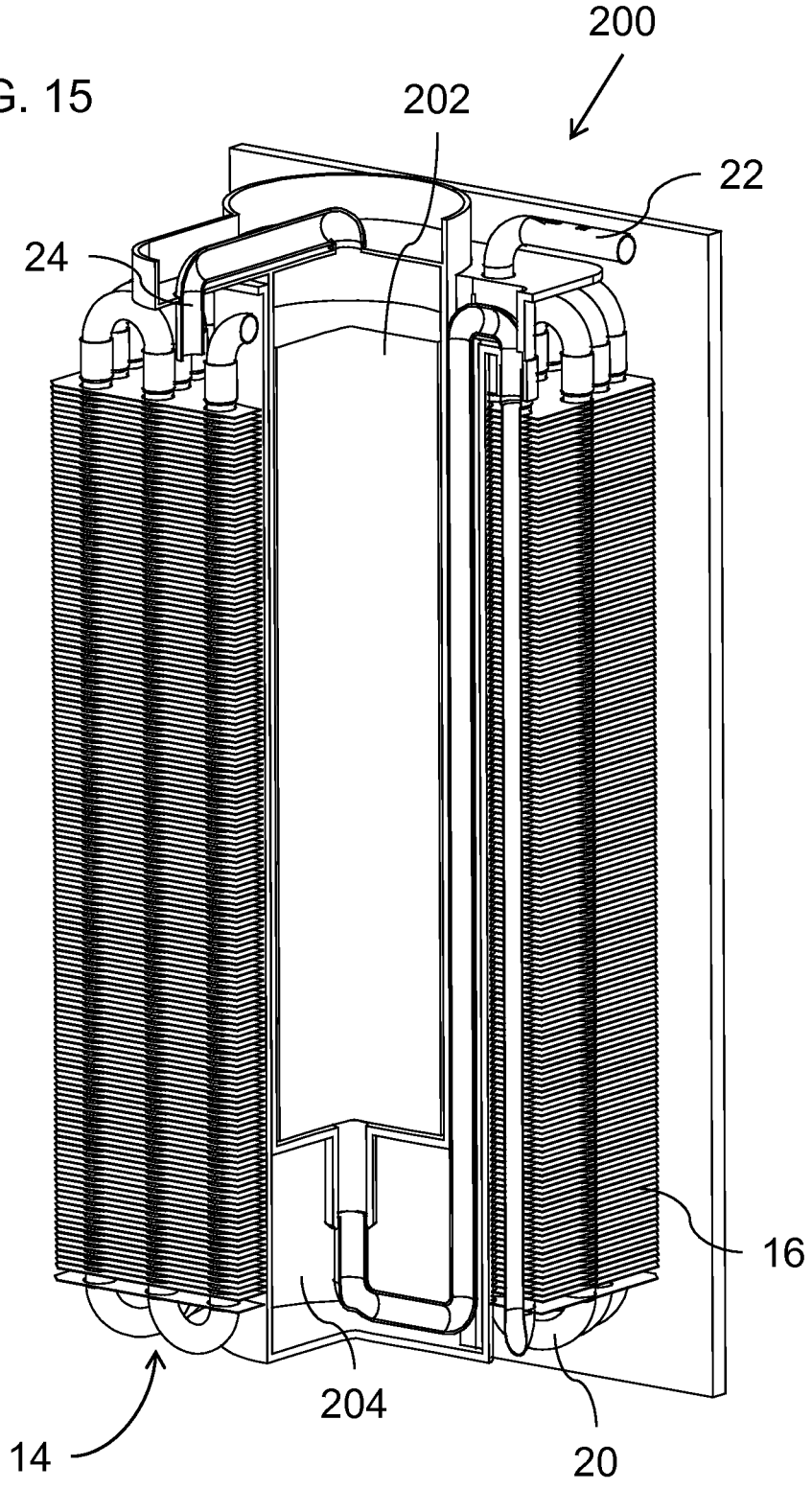
FIG. 15 is an isometric cut-away view of the beverage cooler of FIG. 13 with a cover removed and showing the integrated water filter unit inserted.

Turning finally to FIGS. 13-15, there is shown a further variant beverage cooler, generally designated 200, constructed and operative according to an embodiment of the present invention. Generally speaking, beverage cooler 200 is similar in structure and operation to beverage cooler 10 described above. For ease of understanding, equivalent components are labeled similarly.

In addition to the components described above, beverage cooler 200 additionally includes a water filter unit 202 which is at least partially received within a recess 204 formed in the negative-heat-energy accumulator 14. By including at least part of the water filter unit within the volume of accumulator 14, the accumulator contributes to the cooling and/or helps to maintain the cooled temperature of water within the filter, thereby effectively increasing the capacity of the device to deliver cooled water on demand.

Structurally, recess 204 is preferably substantially surrounded by negative-heat-energy accumulator 14, meaning that, in at least one plane, accumulator 14 extends around at least 270° of the periphery of recess 204. In the particularly preferred implementation shown here, recess 204 is completely encompassed by accumulator 14 and extends to a depth sufficient to receive substantially the entire volume of water filter unit 202.

Conduit 20 is configured to interconnect with water filter unit 202 such that the beverage (in this case, water) passes through the filter as part of the flow path from inlet 22 to outlet 24. In the particularly preferred implementation illustrated here, water filter unit 202 provides the terminal portion of the flow path leading directly to outlet 24. This option provides a number of advantages, including minimizing the volume of water which must be discarded when replacing and flushing the filter.

In all other respects, the structure and function of beverage cooler 200 will be understood by analogy to the description of beverage cooler 10 above.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. A beverage cooler comprising:

(a) a heat pump having a cooling element;

(b) a negative-heat-energy accumulator thermally coupled to said cooling element, said negative-heat-energy accumulator comprising:

(i) a heat-energy dispersion arrangement formed from thermally conductive material, and (ii) a quantity of phase-change material having a phase-change temperature above zero Celsius, said phase-change material being deployed in thermal contact with said thermally conductive material; and (c) a conduit defining a circuitous path for carrying the beverage along at least part of a flow path from an inlet to an outlet, said conduit being thermally coupled to said negative-heat-energy accumulator, wherein said negative-heat-energy accumulator and said conduit are deployed such that an absolute thermal resistance between said cooling element and said quantity of phase-change material is lower than an absolute thermal resistance between said cooling element and water within said conduit, thereby rendering said heat pump effective to cool said phase-change material more rapidly than the beverage within said conduit.

2. The beverage cooler of claim 1, wherein said heat pump comprises at least one thermoelectric cooler (TEC), and wherein said cooling element is a cold plate of said at least one TEC.

3. The beverage cooler of claim 1, wherein said heat pump comprises a vapor-compression refrigeration system.

4. The beverage cooler of claim 1, wherein a majority of a length of said conduit from said inlet to said outlet is immersed in said negative-heat-energy accumulator.

5. The beverage cooler of claim 4, wherein said circuitous path of said conduit includes a plurality of substantially parallel conduit segments passing through openings in said heat-energy dispersion arrangement.

6. The beverage cooler of claim 1, wherein said conduit has an internal diameter, and wherein said circuitous path has a flow-path length greater than 100 times said internal diameter.

7. The beverage cooler of claim 1, wherein said heat-energy dispersion arrangement comprises an arrangement selected from the group consisting of: an array of heat-transfer fins of sub-millimeter thickness; and an open-cell metallic foam.

8. The beverage cooler of claim 1, wherein said heat-energy dispersion arrangement comprises an array of heat-transfer fins of sub-millimeter thickness, said array of fins being spaced apart by gaps of no more than 5 millimeters, said gaps being filled with said phase-change material.

9. The beverage cooler of claim 8, wherein said circuitous path of said conduit includes a plurality of substantially parallel conduit segments passing through openings in said heat-transfer fins.

10. The beverage cooler of claim 1, wherein a majority of a length of said conduit from said inlet to said outlet is integrated within a thermally-conductive block, said thermally-conductive block being thermally coupled to said negative-heat-energy accumulator.

11. The beverage cooler of claim 1, further comprising a water filter unit, wherein at least part of said water filter unit is received within a recess, said recess being substantially surrounded by said negative-heat-energy accumulator, and wherein said conduit is configured to interconnect with said water filter unit such that said beverage passes through said filter as part of said flow path from said inlet to said outlet.

* * * * *